US009249966B1

(12) United States Patent
Hooi et al.

(10) Patent No.: US 9,249,966 B1
(45) Date of Patent: Feb. 2, 2016

(54) HIGH EFFICIENCY SSL THERMAL DESIGNS FOR TRADITIONAL LIGHTING HOUSINGS

(71) Applicant: OptoeElectronix, Inc., San Jose, CA (US)

(72) Inventors: Yap Peng Hooi, San Jose, CA (US); Kow Chuong Chuan, San Jose, CA (US); Kok Chin Vooi, San Jose, CA (US); Jebby Foo Heng Kiat, San Jose, CA (US)

(73) Assignee: OptoElectronix, Inc., San Jose, CA (US)

( * ) Notice: Subject to any disclaimer, the term of this patent is extended or adjusted under 35 U.S.C. 154(b) by 141 days.

(21) Appl. No.: 14/076,544

(22) Filed: Nov. 11, 2013

Related U.S. Application Data

(60) Provisional application No. 61/724,659, filed on Nov. 9, 2012.

(51) Int. Cl.

| | |
|---|---|
| ***F21S 4/00*** | (2006.01) |
| ***F21V 21/00*** | (2006.01) |
| ***F21V 29/00*** | (2015.01) |
| ***F21K 99/00*** | (2010.01) |

(52) U.S. Cl.
CPC ..... *F21V 29/262* (2013.01); *F21K 9/10* (2013.01)

(58) Field of Classification Search
CPC ..... F21K 9/00; F21K 9/30; F21V 29/00; F21V 29/002; F21V 29/20; F21V 29/50; F21V 29/503; F21V 29/70; F21V 29/73; H01L 33/64; H01L 33/644
USPC ..... 362/249.02, 294, 311.02, 800
See application file for complete search history.

(56) References Cited

U.S. PATENT DOCUMENTS

| | | | |
|---|---|---|---|
| 7,102,172 | B2 | 9/2006 | Lynch |
| 7,347,706 | B1 | 3/2008 | Wu |
| 7,878,683 | B2 | 2/2011 | Logan |
| 7,938,558 | B2 | 5/2011 | Wilcox |
| 8,104,929 | B2 | 1/2012 | Kovalchick |
| 8,247,998 | B2 | 8/2012 | Hum |
| 8,256,919 | B2 | 9/2012 | Holder |
| 2004/0233672 | A1 | 11/2004 | Dubuc |
| 2005/0201097 | A1 | 9/2005 | Kiraly |
| 2005/0201098 | A1 | 9/2005 | DiPenti |
| 2005/0207166 | A1 | 9/2005 | Kan |
| 2006/0023423 | A1 | 2/2006 | Kuo |
| 2007/0041185 | A1 | 2/2007 | Yatsuda |
| 2008/0254649 | A1 | 10/2008 | Storey |
| 2008/0274641 | A1 | 11/2008 | Weber |
| 2008/0278954 | A1 | 11/2008 | Speier |
| 2008/0285303 | A1 | 11/2008 | Matsui |
| 2008/0296589 | A1 | 12/2008 | Speier |
| 2009/0001372 | A1 | 1/2009 | Arik |
| 2009/0003009 | A1 | 1/2009 | Tessnow |
| 2012/0212958 | A1 | 8/2012 | Boyer |

OTHER PUBLICATIONS

OTHER PUBLICATIONS

Toshiba TGT Luminaire Brochure; 2012; QD-GS01-SP02-070312-1.
NEMA Outdoor 2010 LSD.

*Primary Examiner* — Jason Moon Han
(74) *Attorney, Agent, or Firm* — Fernandez & Associates, LLP

(57) ABSTRACT

A solid state lighting apparatus comprising a base unit, LED Printed Circuit Assembly comprising a plurality of LEDs, conductive enhancing structure, temperature sensor, Power Supply Printed Circuit Assembly, and optics portion comprising at least one of a lens, holding device, mirror, reflector and/or other optical components. A solid state lighting apparatus is adapted for existing luminaire shapes and is applicable for retrofitting installed luminaires.

5 Claims, 19 Drawing Sheets

FIG. 1A Entire Assembly
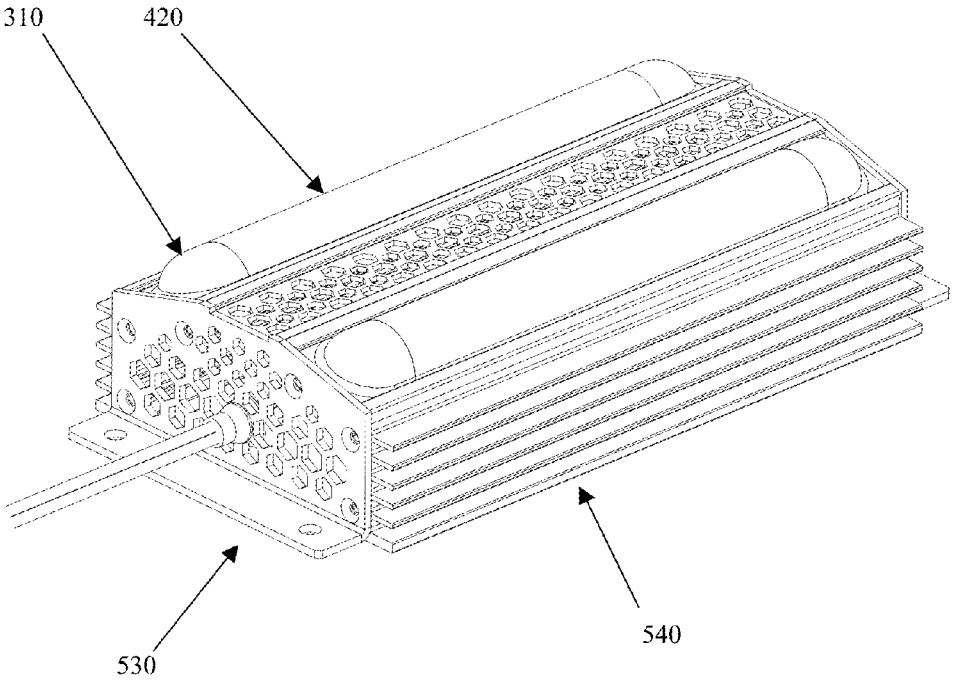

FIG. 1B Exploded Assembly
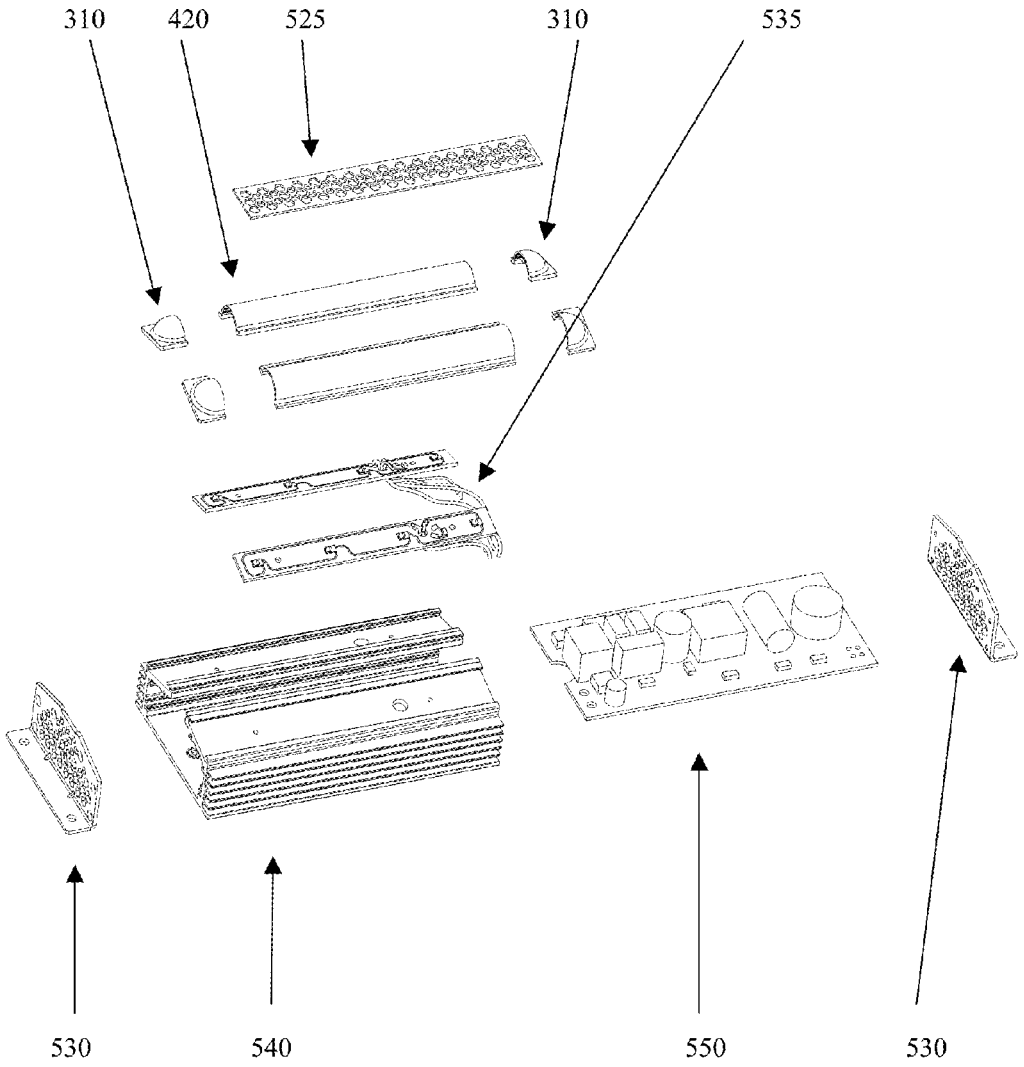

FIG. 2A Extrusion design as used in production
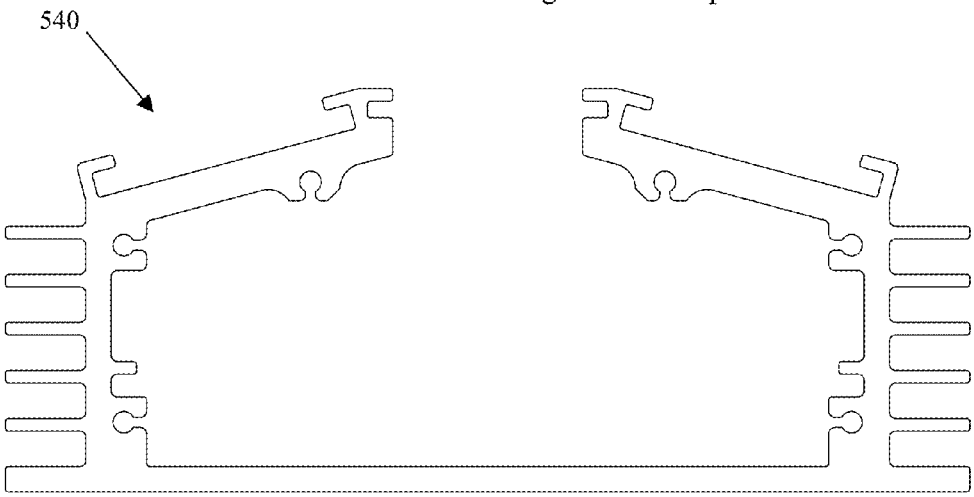
FIG. 2B Alternative extrusion design with slide-in mounting for LED PCB
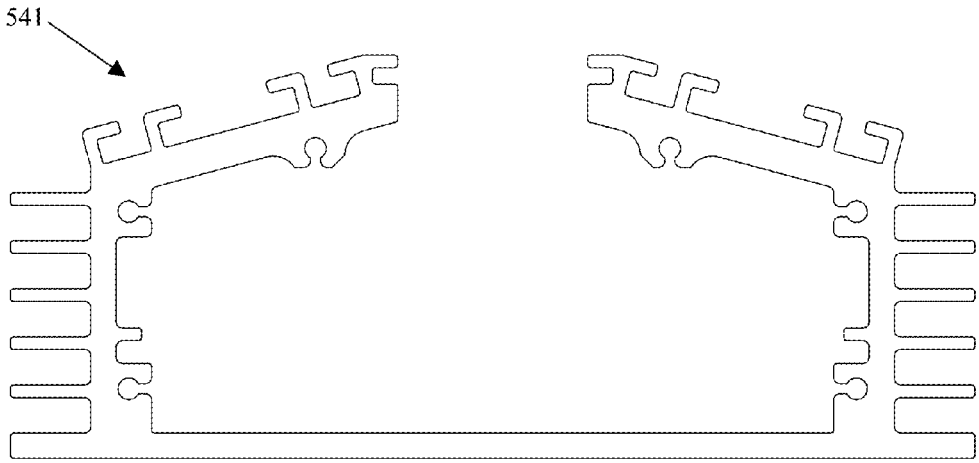

FIG. 3A Exemplary extrusion fin dimensions in mm
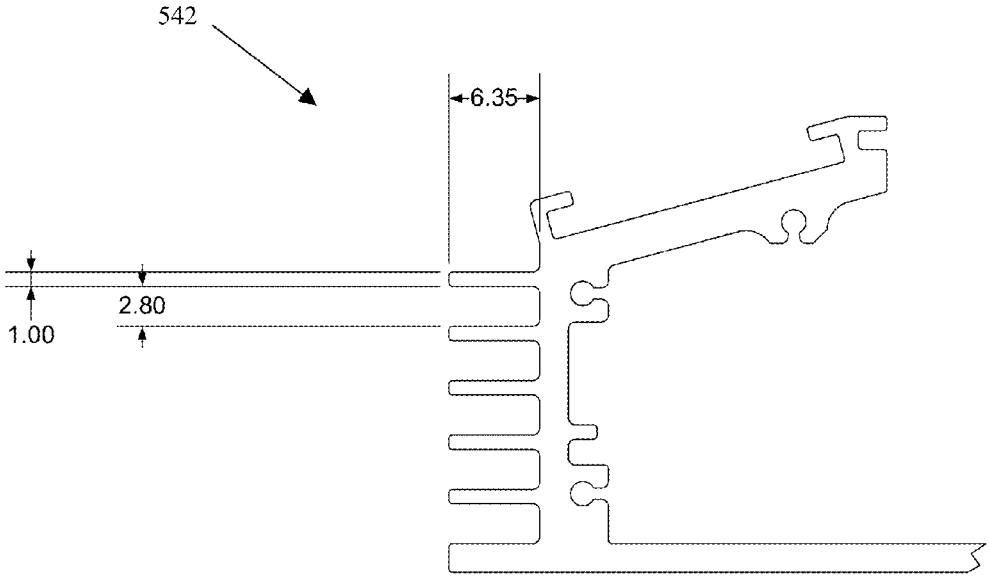
FIG. 3B Exemplary extrusion angle, $\Phi$; $0 \leq \Phi \leq 90^{o}$.
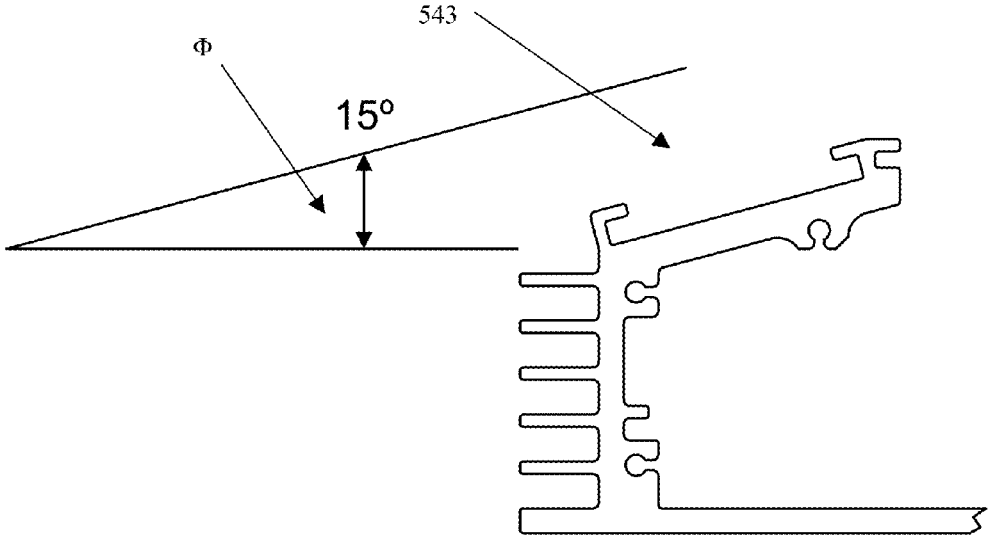

FIG. 4 Electrical Block Diagram
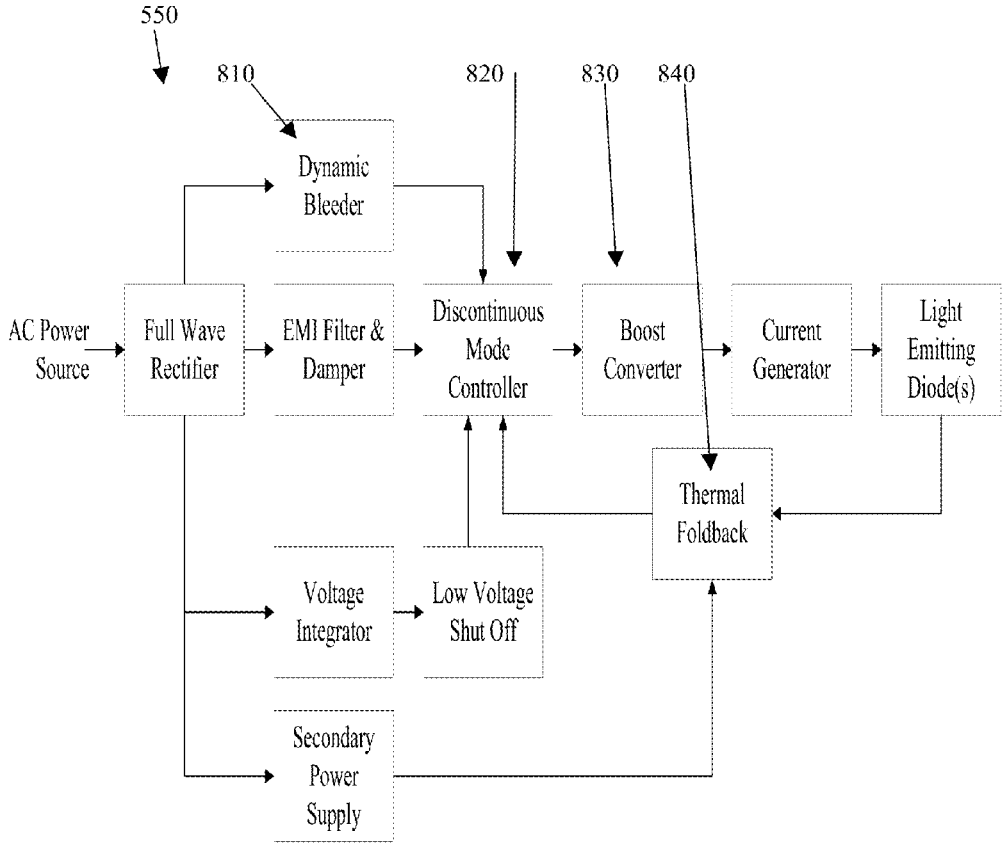

FIG. 17

OPTO electronix

OEI MALAYSIA SDN BHD
1-2-12 KOMPLEKS MAYANG MALL, 1 JALAN MAYANG PASIR 1, BAYAN BARU
11900 PENANG, MALAYSIA
PHONE: (604)-6426688 . FAX: (604)-6426668 . WEBSITE: www.optoelectronix.com REPORT NUMBER : OEIM46811 DATE : 19/10/2012
PRODUCT NUMBER : ULE163VW0 42 K30C80L1100
DESCRIPTION : -
-
-
NOTE : POWER FACTOR = 0.98

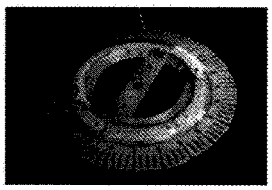

TOTAL INPUT WATTS = 15.4 AT 119.9 VOLTS
TEST DISTANCE = 1.1M

CANDELA DISTRIBUTION

| | 0.0 | 22.5 | 45.0 | 67.5 | 90.0 | FLUX |
|---|---|---|---|---|---|---|
| 0 | 452 | X | X | X | X | |
| 5 | 450 | X | X | X | X | 43 |
| 15 | 439 | X | X | X | X | 124 |
| 25 | 414 | X | X | X | X | 191 |
| 35 | 372 | X | X | X | X | 234 |
| 45 | 314 | X | X | X | X | 243 |
| 55 | 239 | X | X | X | X | 215 |
| 65 | 142 | X | X | X | X | 141 |
| 75 | 52 | X | X | X | X | 55 |
| 85 | 10 | X | X | X | X | 11 |
| 90 | 4 | X | X | X | X | |
| 95 | 2 | X | X | X | X | 2 |
| 105 | 0 | X | X | X | X | 0 |
| 115 | 0 | X | X | X | X | 0 |
| 125 | 0 | X | X | X | X | 0 |
| 135 | 0 | X | X | X | X | 0 |
| 145 | 0 | X | X | X | X | 0 |
| 155 | 0 | X | X | X | X | 0 |
| 165 | 0 | X | X | X | X | 0 |
| 175 | 0 | X | X | X | X | 0 |
| 180 | 0 | X | X | X | X | |

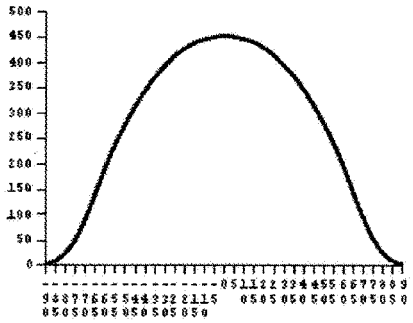

ZONAL LUMEN SUMMARY

| ZONE | LUMENS | %FIXT |
|---|---|---|
| 0- 30 | 359 | 28.5 |
| 0- 40 | 592 | 47.0 |
| 0- 60 | 1050 | 83.4 |
| 0- 90 | 1258 | 99.9 |
| 90-120 | 2 | 0.1 |
| 90-130 | 2 | 0.1 |
| 90-150 | 2 | 0.1 |
| 90-180 | 2 | 0.1 |
| 0-180 | 1260 | 100.0 |

EFFICACY = 81.8 Lm/W
CIE TYPE - DIRECT

CCT = 2989K
BEAM ANGLE = 113DEG

| | |
|---|---|
| Measured | JEBBY |
| Checked | - |

HIGH EFFICIENCY SSL THERMAL DESIGNS FOR TRADITIONAL LIGHTING HOUSINGS

PRIORITY

This application claims priority from U.S. 61/724,659, filed on Nov. 9, 2012, incorporated herein in its entirety by reference.

CROSS-REFERENCE TO RELATED APPLICATIONS

This application references U.S. Ser. No. 12/390,384, U.S. Ser. No. 12/538,060, U.S. Ser. No. 12/431,728, U.S. Ser. No. 12/571,395, U.S. Ser. No. 13/333,919, U.S. 61/641,701, U.S. Ser. No. 13/875,703 and U.S. Ser. No. 13/664,343, all owned by the same assignee and incorporated herein in their entirety by reference.

BACKGROUND OF THE INVENTION

1. Field of the Invention

Embodiments of the invention relate generally to solid state lighting systems with multiple heat sinks replacing conventional lighting means in at least a portion of an original luminaire fixture or similar luminaire fixture.

2. Description of Background Art

Background art has numerous examples of LED based lighting devices; recent ones include U.S.2009/0003009 disclosing a LED lamp projecting light in a forward direction and utilizing a reflector. U.S.2009/0001372 discloses an LED device with a liquid heat transfer fluid; U.S.2008/0296589 discloses a lighting device having a substrate with a thermally conductive region; U.S.2008/0285303 discloses an optical module with an electric wiring interface; U.S.2008/0278954 discloses a mounting assembly for one or more light-emitting elements such that the elements are inferiorly connected to a carrier; U.S.2008/0274641 discloses a lighting fixture with heat removal supporting high intensity LEDs; U.S.2008/0254649 discloses a LED lighting assembly including a printed circuit board with a dielectric layer; U.S.2005/0201098 discloses a LED lighting assembly on an extruded base but not an arm at a angle to the base. Additional background is found in U.S. Pat. No. 7,938,558; U.S. Pat. No. 7,878,683 U.S.2007/0041185; U.S.2012/0212958; U.S. Pat. No. 8,104,929, U.S. Pat. No. 8,247,998, U.S. Pat. No. 8,256,919, U.S. Pat. No. 7,102,172, U.S. Pat. No. 7,347,706, U.S.2006/0023423 and U.S.2005/0201097; also included are Toshiba TGT Luminaire Brochure; 2012; QD-GS01-SP02-070312-1 and NEMA Outdoor 2010 LSD. The aforementioned background art are incorporated herein in their entirety by reference. There is a need for a low cost solid state lighting system enabling high intensity lighting and overcoming the associated heat dissipation issues. The background art does not disclose or suggest the benefits of a solid state lighting system, lamp or fixture with replaceable lens system and high heat dissipation through improved thermal coupling to exterior portions of the lamp. A significant portion of the cost of a new lighting fixture for an LED can be eliminated by replacing only the conventional lighting portion of existing fixtures or luminaire.

BRIEF SUMMARY OF THE INVENTION

One intent of this invention is to provide a means where several LED point sources are positioned in predetermined geometric relationships to a lens or optic assembly, optionally replaceable, in a configuration that enables improved heat dissipation. One aspect of the instant invention discloses a Universal Configurable Light Engine (UCLE), comprising a conduction enhancing structure, rigid or flexible, LED Printed Circuit Assembly comprising a plurality of LEDs, Power Supply Printed Circuit Assembly, and associated optical systems, each comprising a primary optics portion and a secondary optic portion, optionally replaceable; secondary optic portion comprising at least one of a lens, holding device, mirror, reflector and/or other optical components. An optical system directs light generated by one or more LEDs of a UCLE to at least one user selectable target area. In another aspect the instant invention discloses a modular light source comprising a base unit, LED Printed Circuit Assembly comprising a plurality of LEDs comprising primary optics, Power Supply Printed Circuit Assembly, and secondary optics portion comprising at least one of a lens, holding device, mirror, reflector and/or other optical components. A base unit and lens may be extruded, or not.

In some embodiments, a solid state lighting, SSL, system is retrofit into an existing lighting system, replacing existing light fixtures originally designed for bulb technology with SSL technology. By replacing the conventional bulb and it's components with an SSL assembly, and keeping the original housing in place, considerable cost savings accrue, including making use of the environmental design and heat dissipation benefits of an existing fixture. One example of a conventional luminaire is the "Cobra Head", manufactured by, among others, General Electric Co., Cooper Lighting, LLC and Philips Lumec. In one embodiment an existing luminaire is retrofit by adding an opening in the top enabling a heat sink to be coupled to the outer structure of the luminaire; the added heat sink enables a high intensity, solid state lighting system to operate at a temperature such that a L70 life time rating exceeding 60,000 hours is achieved.

BRIEF DESCRIPTION OF THE DRAWINGS

FIGS. 1A and B are schematic drawings of one embodiment of an extruded lens and extruded base LED based lighting system assembly.

FIGS. 2A and B are schematic drawings of two embodiments of an extruded assembly.

FIGS. 3A and B are schematic drawings of alternative embodiments of an extruded base with different LED mounting base angle, Φ.

FIG. 4 is a schematic electrical block diagram for an embodiment of a LED modular lighting system including ability for dimming and voltage control to individual LEDs.

FIG. 17 shows a data set and light output uniformity of one embodiment of a circular lamp.

DETAILED DESCRIPTION OF THE INVENTION

Definitions, Terms, Elements

Figure 5A:
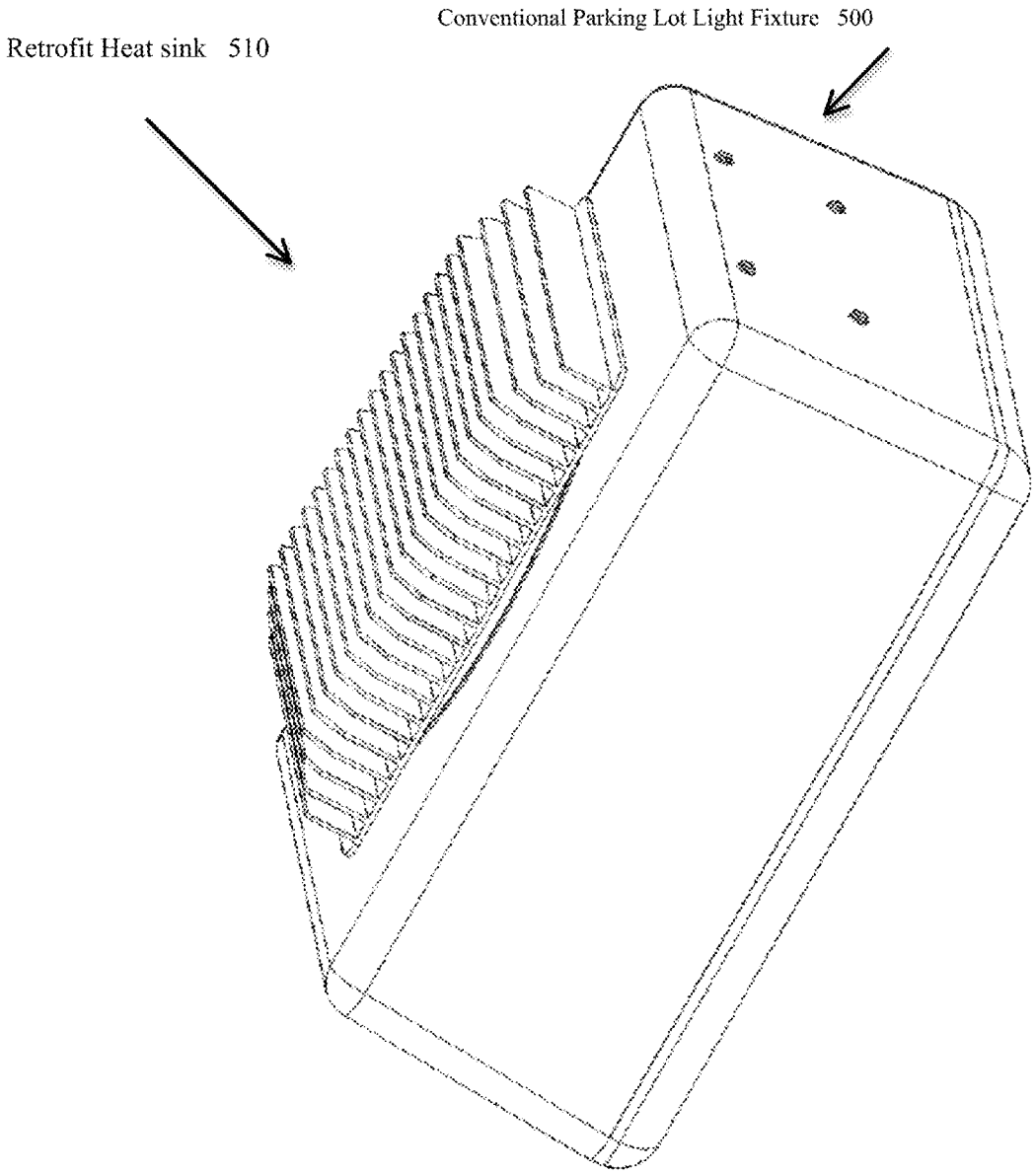
FIG. 5A is a 3D drawing of an embodiment of a Retrofit Parking Lot Light Fixture with rigid conductive enhancing structure.

Adjustable LED illumination angle, Φ: in some embodiments the LED mount can be varied from zero to 90 degrees depending on the illumination pattern required. The LED tilt angle is to meet the illumination target. LED PCB angle, Φ, may vary versus lamp diameter from between about 0° to about 90°.

Conductive enhancing structure: A conductive enhancing structure comprises at least two heat sinks in thermal communication chosen from the following; optionally, a LED portion, a substrate portion, a flexible portion, an expander portion, a rigid portion, each in thermal communication with another; a conduction enhancing structure is characterized by its superior ability for thermal transport from an active LED to an exterior portion of a luminaire. A conductive enhancing structure comprises, optionally, a supplementary heat sink to enable sufficient thermal dissipation capability such that total power can vary between about 10 watts and 1,000 watts while still maintaining a temperature low enough that a life time rating exceeding 60 years is achieved.

Solid state lighting, SSL, system or apparatus: for purposes of the instant invention, an SSL comprises one or more LEDs mounted on a frame or substrate, termed a solid state lighting array, optionally mounted on a printed circuit (board) assembly, PCA, in a predetermined pattern; optionally, LEDs are individually packaged with a lens. The printed circuit board is attached to a heat sink which may also contain space for additional components such as power supply, Power Supply PCA, computing capability, communication capability and other electronics as may be specified. In some embodiments a secondary lens assembly is mounted on the LED printed circuit board assembly such that each LED projects in a predetermined pattern. A SSL apparatus comprises a conduction enhancing structure comprising various elements of the SSL apparatus; optionally, a conduction enhancing structure comprises a plurality of heat conducting portions, including the substrate upon which the LED is initially bonded, a PCA, a first conduction enhancing element or first heat sink and a second conduction enhancing element or second heat sink which is the outer shell or wall or structure or housing of a luminaire wherein each of the plurality of heat conducting elements, including the substrate, are in thermal communication with its neighbors.

Intelligent SSL: SSLs may have intelligence; examples are dimming by remote device; color adjustment, including whiteness, by remote device; automatic on and off set by remote device; a remote device may be a wall switch, smart phone, intelligent home control device or similar remote activation device.

A Base Unit, 540 of FIG. 1, as defined herein, comprises an excellent thermal conductor, termed a conduction enhancing structure, composed of copper, aluminum or other suitable metals, ceramics or composite materials such that a conduction enhancing element conducts heat produced by one or more LEDs and associated Power Supply, to a place remote to the LEDs and electronic components and exterior to the luminaire. Heat flow is facilitated within a Base Unit, and within a conduction enhancing structure, by conduction, convection and radiation. A Base Unit/conduction enhancing structure also dissipates heat through a flat or appropriately shaped portion of one or more of its sides, so as to conduct some portion of internally generated heat to a suitable heat absorbing and transferring object. A Base Unit may also dissipate heat through fins, ridges, buttons, cones, and/or additional surface treatments to enhance either natural or forced air convection of internally generated heat to the environment surrounding a base unit and its associated light emitting devices. A Base Unit, enabled by one or more of these techniques, conducts heat generated internal to a Base Unit away from the temperature sensitive parts of a Base Unit. A Base Unit may comprise means for dissipating and/or reflecting heat originating external to a Base Unit, such as from solar radiation or from other sources, including nearby luminaires or appliances. A Base Unit comprises a portion, 530, optionally threaded, for attaching, optionally inserting, a bolt, screw, pipe or other element, also optionally threaded, made of thermally conductive material, termed a conduction enhancing structure. This structure enhances conduction of heat from a Base Unit to some heat absorbing object or external power absorbing body, remote from the LEDs and electronic components. A conduction enhancing structure in some embodiments also serves as a mechanical support that holds the UCLE securely in a luminaire or other fixture. FIG. 1A shows end lens assembly 310, primary lens assembly 420.

In some embodiments a Base Unit accommodates a conduction enhancing structure that, although threaded, optionally, does not engage with optional threads on a Base Unit. In another embodiment, a portion for attaching, optionally a hole, in a Base Unit is larger than the major diameter of a conduction enhancing structure and includes a provision for allowing clearance for a nut that is engaged with a thread of a threaded conduction enhancing structure. In some embodiments, a Base Unit comprises a conduction enhancing structure comprising springs, clamps, brackets or other thermally conductive members.

FIG. 1B shows exploded assembly view of LED PCB assembly 525, electronics cable, 535 and power supply assembly 550. In some embodiments a Base Unit is made from an extrusion 540 of FIG. 1A and shown also in FIGS.

2A, B and 3A and B as 541, 542 and 543, alternative embodiments of 540. An extrusion can be very low cost when compared to a machined part. In this case an extruded base unit has several distinguishing features, not the least of which is that it is an extrusion; optionally, a base provides a mounting surface for a power supply printed circuit assembly. Cooling fins are spaced and sized such that convective airflow can pass through them with minimum drag from the fin surfaces; exemplary fin dimensions are shown in FIG. 3A for base unit 542. The ratio of fin length to fin spacing is about 2.3 in some embodiments; fin length to fin thickness is about 6.35 in some embodiments; alternatively a base unit of the instant invention may have a fin length to fin spacing in a range from about 1.8 to about 2.8 and a fin length to fin thickness in a range from about 5 to about 7.8. Surface 541 provides support for mounting a LED PCA; in some embodiments a LED PCA is attached with fasteners or screws as in 540; alternatively a LED PCA may slide into a slot formed by extruded part 542 or 543. As shown in FIG. 3B, base unit 543 has arm member at angle Φ from a horizontal parallel to the base 650; angle Φ has range from 0° to 90° or $0° \leq \Phi \leq 90°$, depending upon application. Base unit 540 and other embodiments are extruded in a single piece and then cut to a size appropriate for the number of LED's to be mounted; this may range from two LEDs to several hundred depending on an application.

The LED Printed Circuit Assemblies (LED PCA)

In some embodiments one or more LED PCAs, 525 and power supply assembly 550 with good thermal conduction, are attached to a Base Unit. In some embodiments each LED PCA holds one or more LEDs in the form of prepackaged parts, such as Osram Dragons, Cree X Lamps, Lumileds Rebels or others; in some cases a prepackaged part is an LED array. In other embodiments, LEDs are bare LED chips that are die-attached and lead-bonded in place on a LED PCA. LEDs and LED PCAs are designed to ensure that an Optical System and a thermal network are optimized for maximum efficacy. LED PCAs are connected electrically to a Power Supply PCA comprising a Power Supply with current driver. In some embodiments a LED PCA may comprise LEDs of same or similar light frequency and intensity output, optionally, not; in some embodiments a LED PCA may comprise LEDs of red, blue and green, RBG, color; in some embodiments LEDs of red, blue, green and amber, RBGA, color; in some embodiments LEDS of red, blue, green, amber and white, RBGAW, color; in some embodiments a LED PCA may comprise LEDs forming one or more pixels of a light source such that a UCLE may comprise multiple pixels; in some embodiments a LED PCA may comprise LEDs with phosphors.

Power Supply Printed Circuit Assembly (Power Supply PCA)

A Power Supply PCA is designed specifically to accept power from a wide range of available power sources and deliver appropriate amount of DC current to an LED PCAs. A Power Supply PCA may be attached proximate heat conduction portion 540, for example, such that its internal heat is conducted away by the thermal network formed by a Base Unit and external heat absorbing body. A Power Supply comprises a constant current driver sufficient for one or more LEDs. LEDs and Power Supply are interconnected such that a UCLE device may be connected to either an AC or DC source such as 12, 24, 120, 240 volts or other available voltage source; a Power Supply PCA supplies an appropriate DC current to drive a desired number of LEDs in a series and/or parallel configuration. In some embodiments a Power Supply PCA may comprise a dimming circuit for dimming various LED PCA at similar or different light intensities; in some embodiments a Power Supply PCA may comprise a means for multiplexing various LED PCA at similar or different duty cycles; in some embodiments a Power Supply PCA may comprise a means for processing and storing such that various LED PCA may be programmed through predetermined sequences, optionally, random sequences; in some embodiments a Power Supply PCA may comprise a means for communicating such that commands may be received and status conditions transmitted; in some embodiments a Power Supply PCA may comprise a means for generating a critical flicker frequency and/or twinkle frequency and/or a dazzle condition by a LED PCA. FIG. 4 is an exemplary block diagram of a power supply 550 showing electrical connection to LED PCA, 525. Exemplary Power Supply PCA 550 may comprise dynamic bleeder, discontinuous mode controller, boost converter, a current generator, thermal foldback unit, and various other components such as a full wave rectifier, an EMI filter and damper, a voltage integrator, a low voltage shut-off, and a secondary power supply. As shown in FIG. 1B, power supply PCA 550 is placed interior to extruded base unit 540; end units 530 are ventilated; optionally, a fan or other cooling device is included with a power supply PCA. A printed circuit assembly, as used herein whether for a power supply or LED devices, comprises a substrate chosen from a group comprising printed circuit board, flexible tape, ceramic substrate or other material exhibiting acceptable thermal conduction. In some embodiments a power supply PCA comprises circuits from the Cypress Semiconductor PowerPSoC® family. In some embodiments a power supply PCA comprises, optionally, a processor, a device for communicating such as Bluetooth enabled, and/or a device for sensing and transmitting IR signals.

An Optical System

Figure 5B:
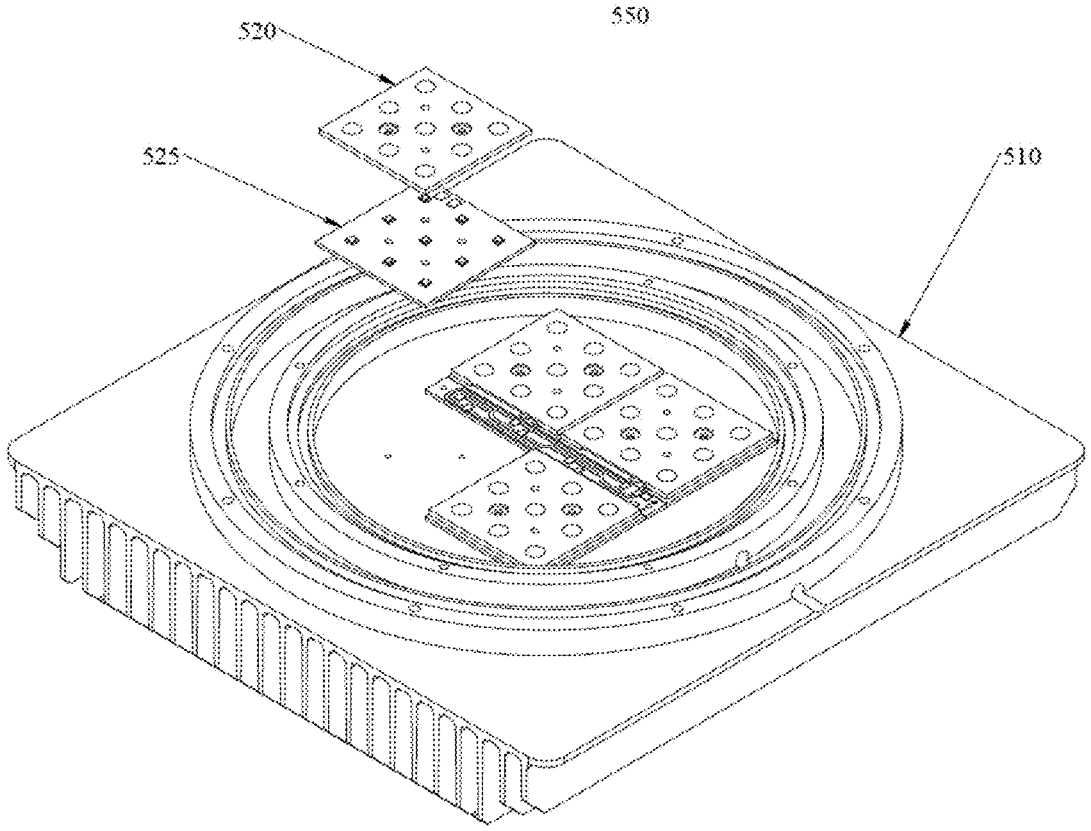
FIG. 5B is an embodiment of a SSL light assembly mounted on the underside of the rigid portion of a conductive enhancing structure.
Figure 7A:
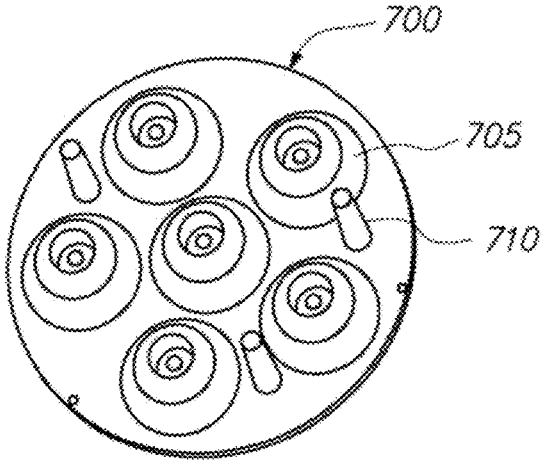
FIG. 7A is a schematic drawing of an embodiment of a secondary lens assembly.

In some embodiments employing LED PCA 525 comprises optional primary optics portion optionally included in the packaged LEDs and a "user replaceable" secondary optic, or secondary lens, portion, 520 and 700, as shown in FIGS. 5B and 7A. An Optical System may also include a space between the LED primary optics and secondary optic portion lenses and/or reflectors. This space may comprise air or a liquid or solid material used for refractive index matching to primary and/or secondary optics. In cases where a gap between primary optic and secondary optic holds air or other material having an index of refraction differing substantially from the material making up the primary and secondary optics, this gap forms an element in the lens system. By varying the size, shape and material within this gap, the properties of the lens system are varied and the beam pattern is directly affected. In some cases a packaged LED is an array of LEDs, optionally, comprising primary optics, secondary optics, and/or lenslet portions.

In embodiments of the invention, an optical system comprises at least one secondary optic portion, comprising at least a single, molded, cast, machined, extruded or otherwise fabricated secondary optical component comprising one or more lenses and, optionally, reflector, mirror, polarizer, filter, lens, diffuser, and/or other optical component, for each of one or more LEDs; optionally, the components of the secondary optic portion are individually matched to the LEDs. In some cases components of a secondary optic portion are identical in design and optical properties and, optionally, not. In some embodiments, all primary and secondary optic portions of an Optical System are designed to direct light to a common target area, optionally overlapping; for instance, multiple LEDs illuminating an area of a single counter top. In some embodiment, each primary and its optional, associated secondary optic portion is directed to its own target area, optionally, all different; for example illuminating individual panels of a luminaire. In other embodiments multiple primary and optional, associated secondary optic portions are directed to various target areas in a designated space in endless combinations to product unique optical effects. A user may adjust the direction and/or intensity of one or more of the LEDs in an Optical System in some embodiments. Additional variation and flexibility are achieved by replacing a secondary optic portion and/or the primary and LED(s) associated with a replaced secondary optic portion.

In some embodiments of the invention a secondary optical portion comprises a holding device, not shown, that engages with a base unit and holds one or more optical components, fabricated as separate devices. These individual components are focused on designated target areas. In some embodiments additional optical component combinations are inserted into a holding device as part of a UCLE manufacturing process. In another embodiment, optical component combinations are delivered to a particular stage in the product sales and distribution channel, where individual optical component combinations are matched to particular lighting applications. In still other embodiments, optical component combinations are selected and installed by luminaire end-users.

In one embodiment of the invention the LEDs are mounted to a base unit such that light is emitted in a direction away from a target area or at some particular angle that does not point directly to a target. A mirror is then positioned such that the light is intercepted and reflected to the target area. The mirror can be a flat planar mirror, producing a uniform illumination or it can have an asymmetric shape. The asymmetric shaped mirror reflects the light in such a way as to produce a beam pattern on the target area that can be circular, elliptical, rectangular, triangular, or irregular in dimension and shape, in order to facilitate a particular lighting need. A secondary optic mirror may be combined with other optical elements, such as polarizers, filters, lenses, diffusers, etc. in order to condition the shape of the resulting beam to produce a desired lighting. This indirect lighting method using the mirror and other optical elements described here can be adjusted by the end user in the same way as the User Configurable Light Engine described above.

In some embodiments a replaceable optics module 700 comprises a plurality of lenses 705 covering the LED PCA, not shown, such that each LED is in optical communication with a lens of the cover module. In some embodiments an extruded lens 420 is employed; an extruded lens may be is of various optical properties or functionalities; in some embodiments an extruded lens is an aspheric collimator lens; an extruded aspheric collimator lens forms a virtual image of the associated LED at a focal plane located at "infinity". Focusing occurs in a plane perpendicular to the extruded axis of the lens. The angular extent of the collimated plane is controlled by the focal length and size of the LED emitting surface. In some embodiments a lens is a side emitter lens. A side emitter lens is designed to redirect a light ray out of LED from a forward or outward direction to a lateral direction in a plane perpendicular to the extruded axis of the lens. Forward directed rays from an LED are redirected via total internal reflection, TIR; light rays exiting an emitting surface at a sufficiently large angle with respect to the optical axis of the LED are redirected via refraction. In some embodiments a lens is a horizontal isotropic lens. A horizontal isotropic lens directs light in a plane perpendicular to the axis of a lens such that the intensity of emitted light ray is independent of its emission angle. The redirection is accomplished with a series of faceted surfaces in conjunction with a curved aspheric surface located at a central portion of the field of view. In some embodiments a lens is a lens of aspheric shape functioning in cooperation with individual lenslets located over a plurality of LEDs. A lenslet and extruded lens of aspheric shape functioning cooperatively may focus emitted light from a LED in a plane parallel to the axis of the extruded lens. An extruded lens of the instant invention may be used with a lenslet or appropriate secondary lens to accomplish a desired light emitted pattern. In some embodiments a lens may utilise holographic and/or engineered diffusing elements. These elements may be made of malleable film and located on an inside surface of a lens; alternatively, diffusing elements may be "imprinted" onto a surface of an extruded lens. Imprinted and/or film elements enable direction of emitted light specific to various applications. In some applications a lens cap, 310, is placed on an end of a lens 420 to direct light in a desired manner; optionally two lens caps are used. In some embodiments end piece 530 holds lens cap 310 in place against lens 420; lens cap 310 and extruded lens 420 are secured to base unit.

In some embodiments of the invention a thermal feedback module continuously monitors and adjusts LED current to ensure that LEDs do not overheat. A LED PCA comprises a thermal sensing element, for example a thermistor, for monitoring the temperature of at least one LED. A power supply PCA module senses the thermal sensing element output and continuously monitors LED temperature; should LED temperature approach an upper or lower limit of predetermined temperature limits the power supply adjusts the LED current to a level where LED temperature is maintained within the predetermined operating region. Optionally, temperature sensing and LED current drive is operated in a closed loop feedback system to ensure continuous reliable operation. Examples of situations that may cause LED's to operate at high temperatures are: light fixtures where airflow has been blocked; light fixtures where external sources, for instance sunlight, may impact on a fixture at certain times of the day when the fixture is operating; light fixtures installed in applications for which the product was not intended due to excessive ambient temperatures.

In some embodiments of the invention a user configurable light engine comprises a base unit, a LED PCA attached to the base unit, a secondary optical system attached to the LED PCA; and a power supply PCA comprising a current source attached to the base unit wherein a user may replace the secondary optical system. Optionally a user configurable light engine further comprises a primary optical system comprising at least one of a lens or reflector such that said LED PCA has a primary optical system communicating with said secondary optical system. Optionally, a user configurable light engine comprises at least a first and second LED PCA. Optionally, a user configurable light engine directs its light in a direction apart from said at least second LED PCA. Optionally, a user configurable light engine comprises a plurality of LEDs and plurality of secondary optical systems such that there are a first LED with a first secondary optical system and a second LED with a second secondary optical system and the first secondary optical system may be different from the second secondary optical system. Optionally, a user configurable light engine comprises a LED PCA comprising a temperature sensing element and a power supply PCA operable to continuously adjust the current to said LED PCA based upon predetermined temperature limits.

In some embodiments of the invention a user configurable light engine comprises a base module, a power supply PCA comprising a current source attached to the base module, a LED PCA comprising a plurality of LEDs; and a replaceable cover module comprising a plurality of lenses covering the LED PCA such that each LED is in optical communication with a lens of the cover module. Optionally, a user configurable light engine comprises a cover module comprising an asymmetric mirror such that a rectangular pattern of light is projected from the user configurable light engine.

Optionally, an apparatus for directing light comprises a base unit comprising cooling fins wherein the cooling fins have a fin length to fin spacing in a range from about 1.8 to about 2.8 and a fin length to fin thickness in a range from about 5 to about 7.8. In some embodiments a lighting apparatus comprises lens chosen from a group comprising side emitting lens, image forming aspheric lens, horizontally isotropic lens, holographic engineered diffuser lens, and aspheric collimating lens. Optionally, an apparatus for directing light comprises a LED PCA comprising a lenslet. Optionally, an apparatus for directing light comprises a power supply PCA comprising at least one chosen from a group comprising dynamic bleeder, discontinuous mode controller, boost converter, thermal foldback unit, thermal feedback module and secondary power supply. Optionally, an apparatus for directing light comprises a base unit wherein said angle 4 is between about 1° and about 25°; optionally, the angle is between about 0° and about 90°. Optionally, an apparatus for directing light comprises a LED PCA comprising a temperature sensing element and said power supply PCA is operable to continuously adjust the current to said LED PCA based upon predetermined temperature limits.

In some embodiments an SSL system comprises elements for retrofitting into an existing conventional lamp; examples are interior luminaires and exterior luminaires, such as street lamps or parking lot lamps. In some embodiments an opening in the existing conventional fixtures is made with sufficient clearance to allow for interior components comprising elements of a SSL assembly and an exterior portion of a conductive enhancing structure, optionally, heat fins with access to the ambient air, and full exposure of the large area of heat fins required to dissipate excess heat generated by an SSL apparatus, as shown in FIGS. 5A and 5B. FIG. 5A shows schematically a parking lot light fixture 500 with added conductive enhancing structure portion, rigid heat sink 510. The result is a retro-fit with the thermal performance required for the power density desired. FIG. 5B shows schematically a SSL light assembly 550 attached to the underside of conductive enhancing structure portion, rigid heat sink 510 comprising LED PCB 525 and secondary optics module 520. A SSL light assembly 550 is placed interior to parking lot light fixture 500; however the conductive enhancing structure extends from the LED PCB 525 to the rigid heat sink portion 510 to the exterior of the light fixture 500 providing a continuous thermal path to the exterior portion of the luminaire.

Conventional solutions, as disclosed by U.S. Pat. No. 8,256,919, are totally contained within the interior of an existing luminaire housing; these lamps are limited by the size and thermal properties of a housing built for the much different thermal requirements of older bulb technologies. The instant invention discloses a conductive enhancing structure and SSL assembly designed to provide power density and thermal constraints according to the design requirements of the SSL assembly, not the limitations of the existing bulb fixtures being retro-fitted. Staying within a strict thermal window is critical to achieving long life of the SSL assembly.

In some embodiments a SSL lighting apparatus is designed to function with a lamp fixture, optionally, with interchangeable optics providing a viewing angle from 10 degrees to 120 degrees. A fixture may be a landscape fixture, a down-light, a light with ceiling fan or other types. A modular lamp may use various optics and various power supplies; the lamp is designed to transfer heat from a LED PCA to a decorative fixture using a conductive enhancing structure comprising a flaring expander mechanism. A modular LED lamp may operate from 12V, AC or DC, and from 90 VAC to 305 VAC; a lamp may be round, square, hexagonal or other shapes and sizes from less than 2 inches to more than 12 inches in diameter.

Figure 6A:
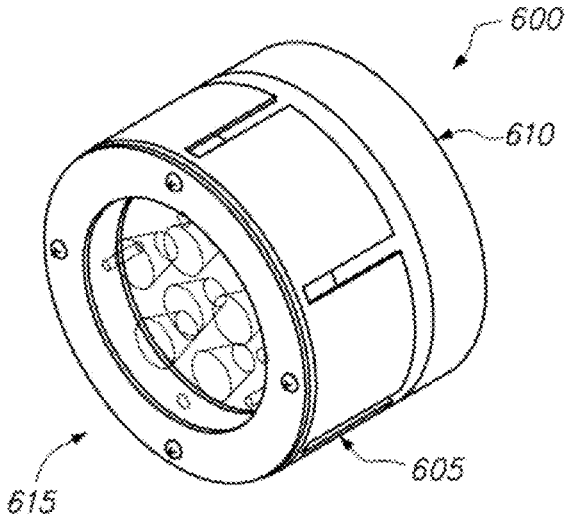
FIG. 6A is a schematic drawing of one embodiment of flexible conductive enhancing structure with expander portion, optical assembly.
Figure 6B:
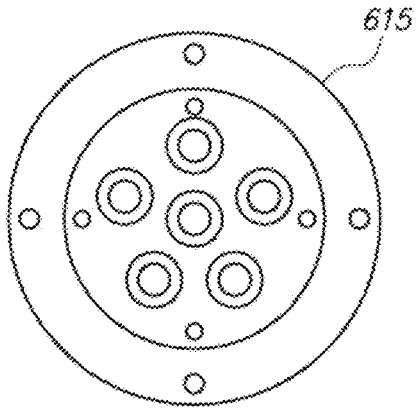
FIG. 6B is a top down view of the optical assembly and cover plate.
Figure 6C:
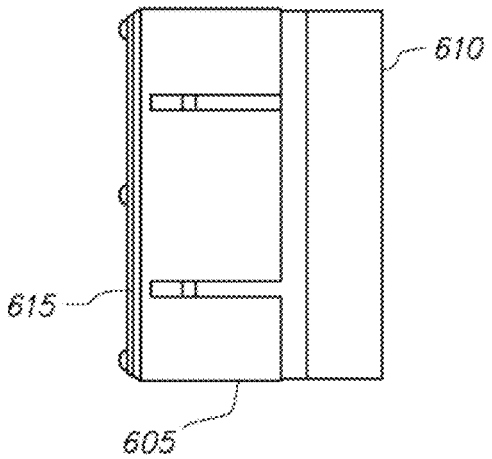
FIG. 6C is a side view of a flexible portion of a conductive enhancing structure with expander portion and cover plate.
Figure 6D:
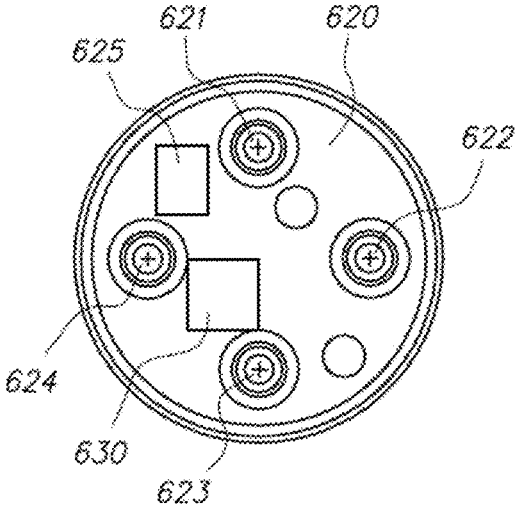
FIG. 6D is a bottom view showing expander screws and electrical components.

In some embodiments a modular lamp comprises a conductive enhancing structure whereon the LEDs and electronic components are mounted. Heat generated by LEDs is dispersed throughout the conductive enhancing structure. In some embodiments, shown schematically in FIGS. 6, 7, 8 and 9, a conductive enhancing structure 600 comprises a flexible portion 605, an expander portion 610 and cover plate 615; all shown in FIG. 6A; FIG. 6B is a top down view of cover plate 615 showing lens module 700 underneath. FIG. 6C is a side view of 600 showing expander portion 610 inserted into flexible portion 605. FIG. 6D is the underside of expander portion 610, labeled as 620; tension screws 621, 622, 623, 624 are tightened into expander portion 610 to cause it to expand out flexible portion 610; this is shown in more detail in FIGS. 9A, 9B, and 9C. A power supply PCB 630 and other electronic components 625, such as means for computing, means for communication, means for thermal sensing, means for thermal regulation by current or voltage modulation and others as may be required, are shown schematically.

Figure 11:
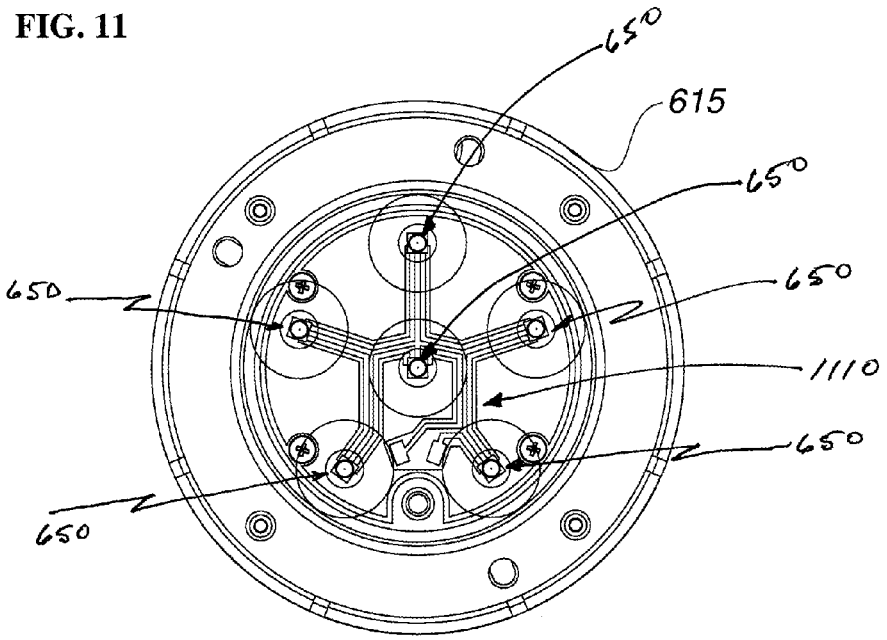
FIG. 11 shows schematically LED placement in the embodiment of FIG. 6.

FIG. 11 is a more detailed view of FIG. 6B showing the location of LEDs 650 in six distinctive locations; circuitry 1110 to the LEDs is also shown.

Figure 7B:
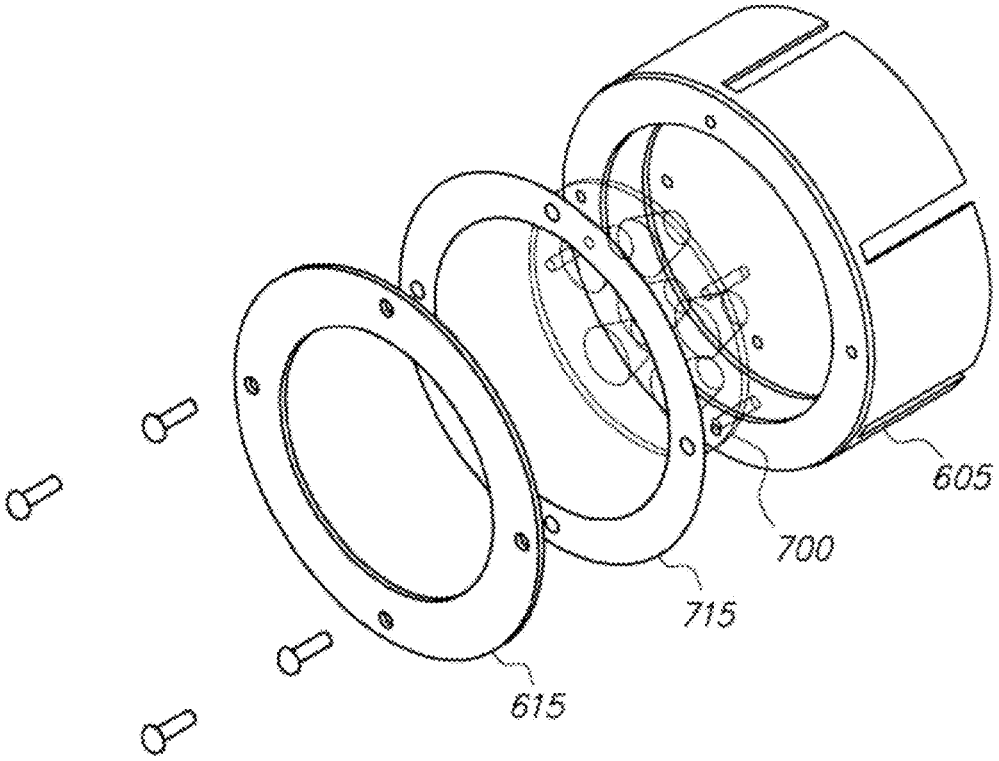
FIG. 7B is an exploded schematic drawing of an embodiment of a secondary lens assembly and expandable portion, flexible portion, conductive enhancing structure.
Figure 8:
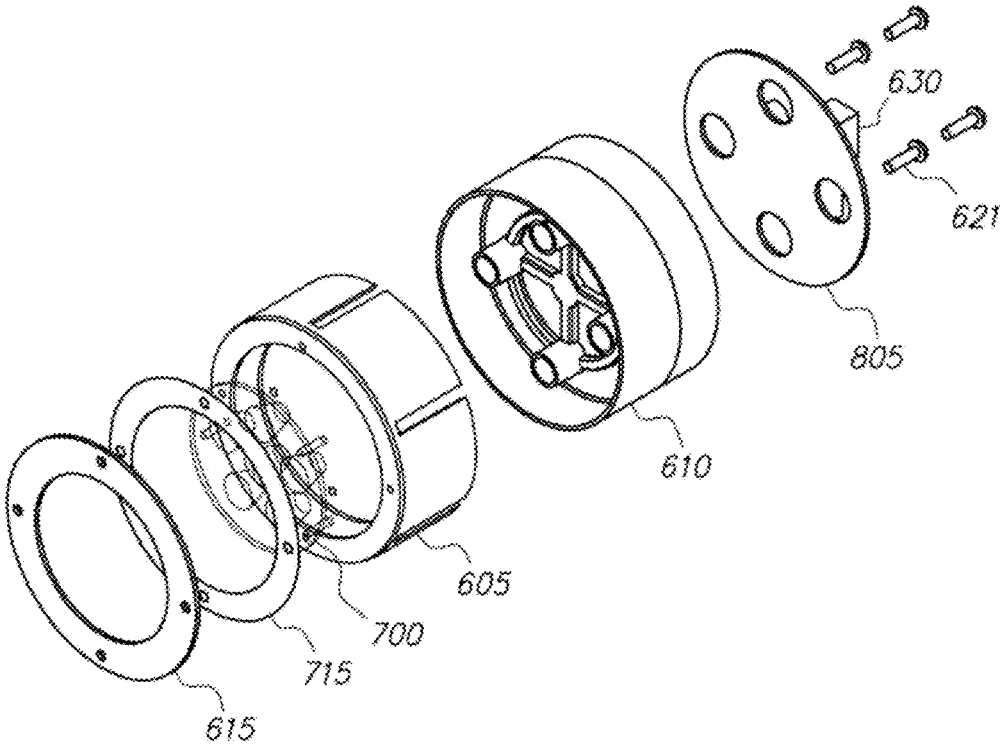
FIG. 8 is an exploded schematic drawing of an embodiment of an expandable flexible portion, expander portion and PCA assembly.
Figure 9A:
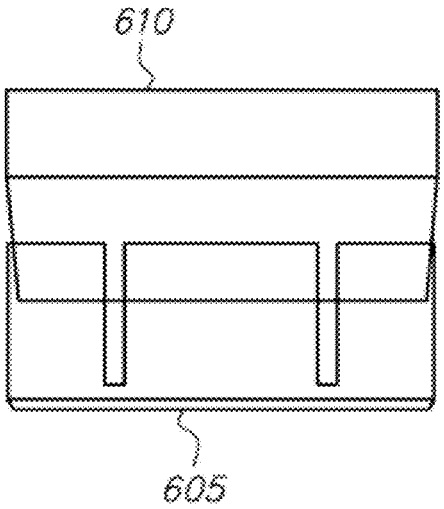
FIG. 9A is a schematic drawing of an embodiment of an expandable flexible portion and expander portion of a conductive enhancing structure.
Figure 9B:
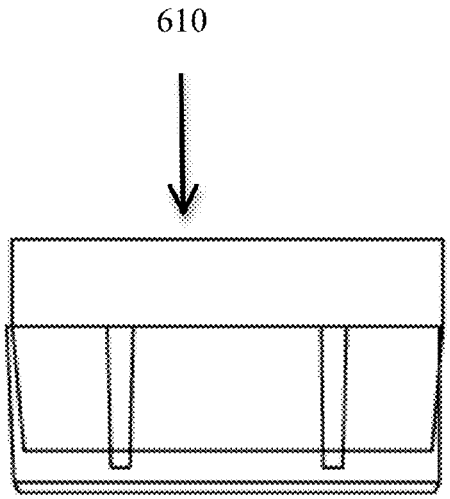
FIG. 9B is a schematic drawing of an embodiment of an expandable, flexible, conductive enhancing portion and expander portion expanded.
Figure 9C:
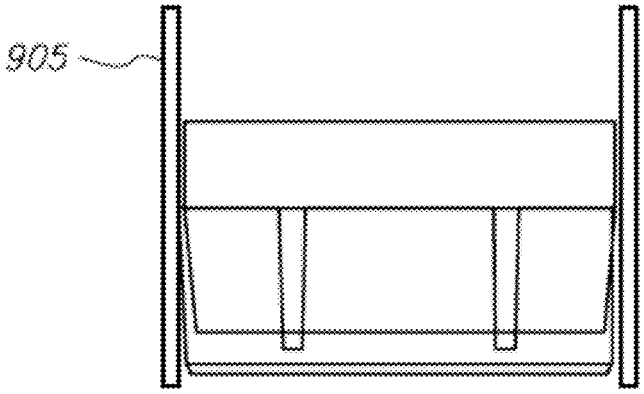
FIG. 9C is a schematic drawing of an embodiment of an expandable, flexible, conductive enhancing portion and expander portion expanded and placed inside a luminaire structure.

FIG. 7A shows secondary optics assembly 700 comprising optics 705 and standoff stud 710. FIG. 7B shows an exploded view of cover plate 615, seal gasket 715, optics assembly 700 fitting on to flexible portion 605; not shown is a LED assembly inserted between 700 and 605. FIG. 8 is an exploded view of the entire assembly with added element substrate portion 805 fitting into the underside of expander portion 610 for mounting of components 625 and 630; substrate 805 is an element of the conductive enhancing structure providing thermal paths through flexible portion 605 to luminaire exterior wall as shown in FIG. 9C. FIG. 9A shows expander portion 610 positioned above expander portion 605; FIG. 9B shows expander portion 610 inserted into 605; FIG. 9C shows SSL assembly, comprising 605 and 610, inserted into a luminaire making good thermal communication with luminaire external wall 905 such that luminaire external wall 905 is a contributor to the overall performance of the conductive enhancing structure. An external wall 905 is also referred to as an outer cover or outer shell.

Flexible portion 610 is typically of a metallic composition or other good thermal conductor; expander portion is made of a variety of materials, including plastic. An expander block may be designed with tapered sidewalls. When inserted into an expandable heat sink portion an expander block flares the heat sink outwards. The amount of flaring is controlled by tightening tension screws 621-624, from the back. This enables the outer walls of the flexible portion 605 to maintain thermal contact with the inner and exterior walls of the lamp fixture 905. Heat generated from mounted LEDs is dispersed effectively to the fixture through this flaring mechanism. The expander may also function as a casing for a power supply 630 and other electronic components 625.

In some embodiments a modular lamp comprises an outer, decorative or ornamental covering or wall or shell and inner functional components. Examples of outer decorative coverings are shown on www.hadco.com/Hadco/Public/SearchVisual.aspx?FamId=7 [Oct. 16, 2013]. The instant invention is not limited to these coverings or shells or shapes; any shape or fixture allowing the functioning of an expandable thermal heat sink is acceptable. Inner functional components comprise the elements shown schematically in FIGS. 6, 7, 8 and 9. In some embodiments a modular lamp comprises an outer, decorative or ornamental covering 905 and inner functional components comprising expandable heat sink 605, expander block 610, cover plate 615, optional gasket 715, lens assembly 700, LEDs and mounting substrate 750, expander screws, 621-624, power supply 630, electrical component(s) 625; optional electrical components may comprise temperature sensor, dimmer and/or color modulation, communication capability, computing capability or other functionality known to one knowledgeable in the art.

Figure 10:
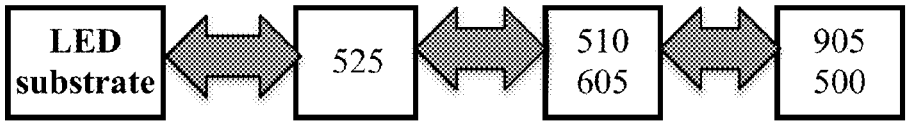
FIG. 10 shows schematically the thermal path from an LED and its substrate to the outer housing of its luminaire.

Various embodiments of the instant invention, during Dept. of Energy type testing, have demonstrated a projected degradation of 1% over 60,480 hours for over 100 watts of LED SSL power at a maximum case temperature of 85° C. Different embodiments can operate from 10 to 1,000 watts in existing, conventional luminaire fixtures, while maintaining the desired thermal performance required to achieve the stated LED efficiencies and lifetimes. The degradation lifetime calculation is based on the Illuminating Engineering Society's TM-21-11: Projecting Long Term Lumen Maintenance of LED Light Sources. Calculation results have been validated by NIST. FIG. 10 shows schematically the heat conduction path between the LED and its substrate to LED assembly PCB 525 to a first heat sink 510 or 605, optionally other heat sinks, not shown and then to outer wall or cover or housing 905 or 500.

In some embodiments a solid state lighting apparatus comprises a solid state lighting array comprising a plurality of LEDs, optionally each has a lens, and a substrate; a first heat sink operable to support a substrate on which the solid state lighting array is mounted comprising a flexible portion; an expander portion; a lens assembly comprising at least one optical component for each LED wherein the lens assembly is placed over the LEDs on the first heat sink; and an outer cover operable to function as a second heat sink; wherein the expander portion comprises locations for electrical components and is operable to expand against the flexible portion when one or more tension screws are tightened into the expander portion such that the flexible portion is placed in thermal communication with the outer cover; optionally, the lens assembly comprises at least one optical component chosen from a group consisting of side emitting lens, image forming aspheric lens, horizontally isotropic lens, holographic engineered diffuser lens, and aspheric collimating lens and mirror; optionally, the electrical components comprise at least one chosen from a group consisting of dynamic bleeder, discontinuous mode controller, boost converter, thermal fold back unit, thermal feedback module, temperature sensor, means for communication, means for computing, means for dimming and means for modulating color of the LEDs and power supply; optionally, the outer cover is chosen from a group consisting of cylinders, rectangular solids, ellipsoids and other shapes operable to make thermal contact with a flexible, expandable heat sink; optionally, the plurality of LEDs are maintained at a temperature of 85° C. or less when dissipating less than about 300 watts.

In some embodiments a solid state lighting apparatus for an existing luminaire comprises a solid state lighting array comprising a plurality of LEDs; optionally, each LED has a lens, and a substrate; a first heat sink operable to support the substrate on which the plurality of LEDs are attached comprising locations for electrical components and placed interior to the existing luminaire; a lens assembly comprising at least one optical component for each LED wherein the lens assembly is placed over the solid state lighting array on the heat sink; and a second heat sink in thermal communication with the first heat sink and placed on an exterior portion of the existing luminaire; wherein an opening is added to the existing luminaire for the purpose of placing the solid state lighting array into the interior of the existing luminaire wherein the main body of the second heat sink is physically larger than the opening added such that at least a portion of the main body of the second heat sink and a portion of the exterior of the existing luminaire are in thermal communication; optionally, the existing luminaire provides lighting outdoors; optionally, the plurality of LEDs are maintained at a temperature of 85° C. or less when dissipating less than about 1,000 watts.

Figure 12:
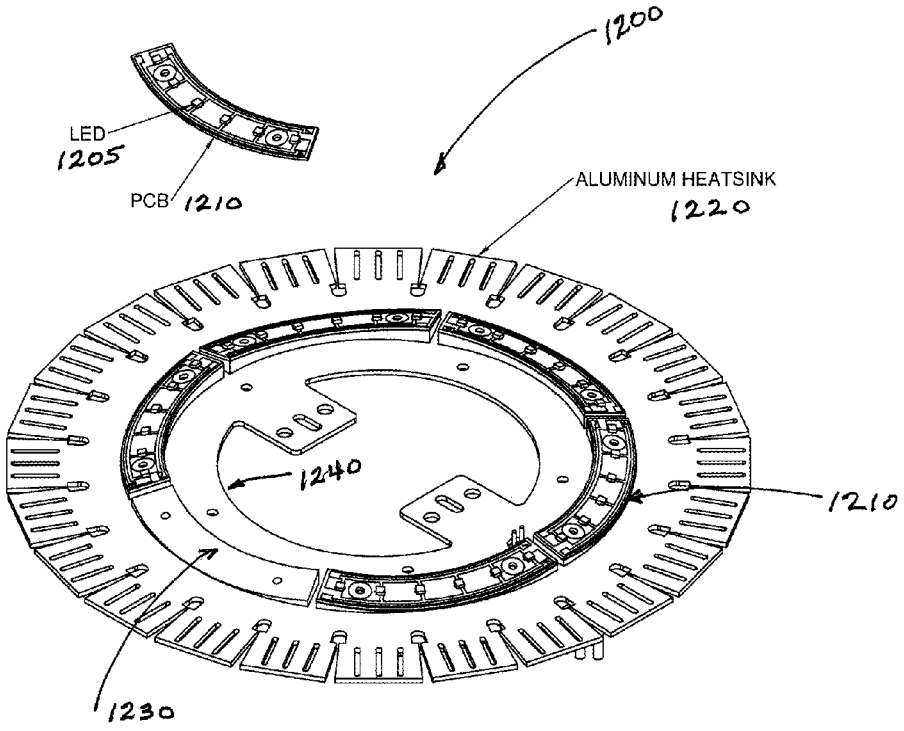
FIG. 12 shows schematically one embodiment of a circular lamp after attachment of LEDs and before bending of the heat sink portion.

Another embodiment of the invention is shown is FIG. 12, a modular LED lamp enabling a user to install the optics at a point of use. Thermal management is enhanced from the effective heat transfer using the flaring heat sink 1210 mechanism. FIG. 12 shows lamp assembly 1200 before heat sink 1210 is bent, as shown in FIGS. 13-16.

A circular lamp, as shown in FIGS. 12-16, uses a flexible heat sink with varying sizes, shape and LED tilt angles. Varying LED tilt angle is shown in FIG. 12 where pcb 1210 with LED 1205 mounted thereon is placed on LED mounting frame 1230; as shown in FIG. 12 there are six individually adjustable LED mounting frames wherein the angle of the LED mounting frame is adjustable between about ±45° of the 0° as-stamped position. In some embodiments The LED mount can be varied from zero to 90 degree depending on the illumination pattern required. LEDs are arranged in a circle to optimize the illumination uniformity over 180 degrees or over a hemisphere. In some embodiments a Supplementary Heat Sink can be added when necessary to increase the power of the lamp. In some embodiments features include Intelligent capability such as dimming, ambient and motion sensors, remote programmed controls and emergency lighting.

Figure 13:
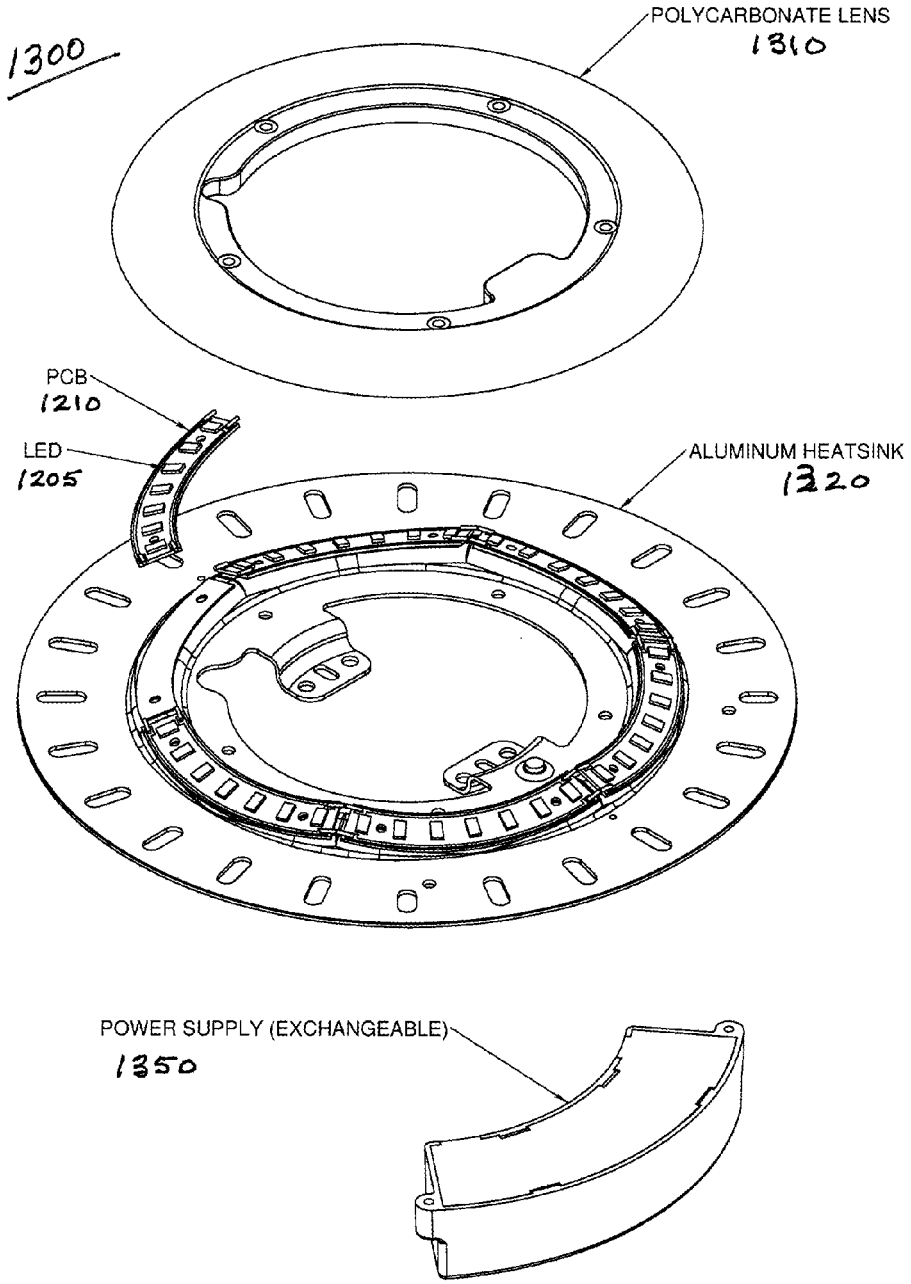
FIG. 13 shows schematically one embodiment of a circular lamp after attachment of LEDs and before bending of the heat sink portion.
Figure 14:
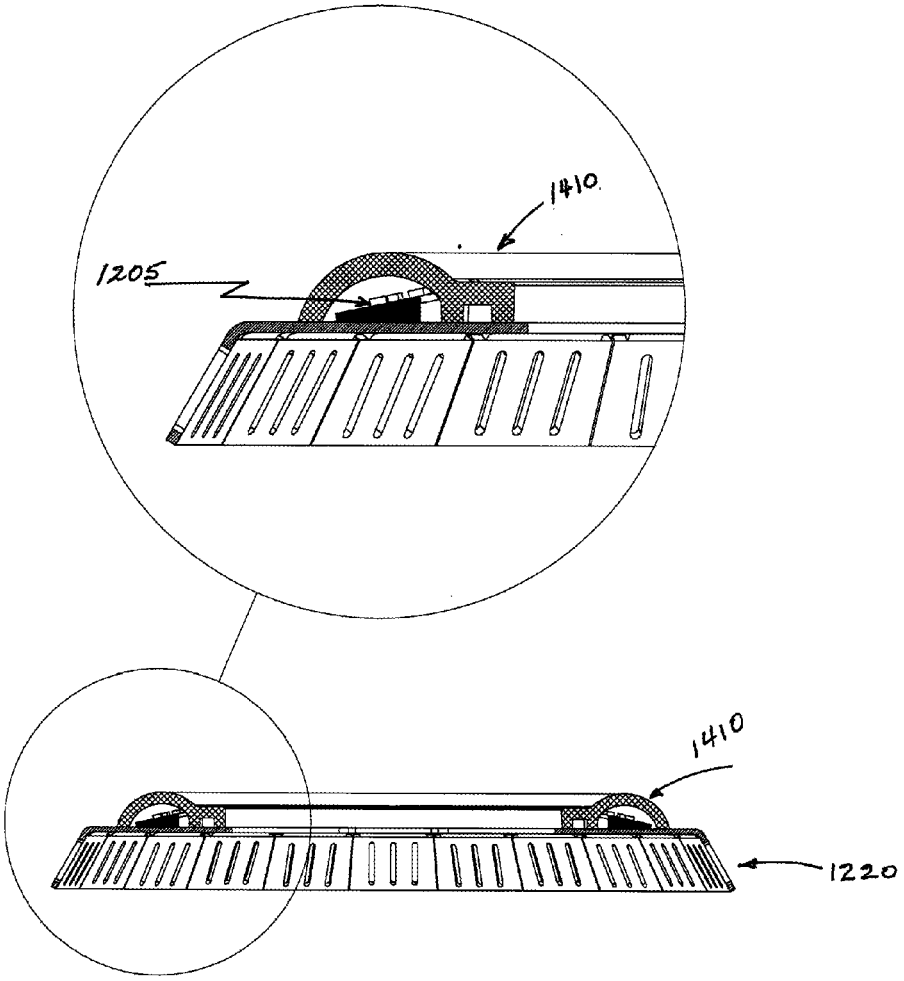
FIG. 14 shows schematically and expanded view showing LED tilt angle on a circular lamp frame.
Figure 15:
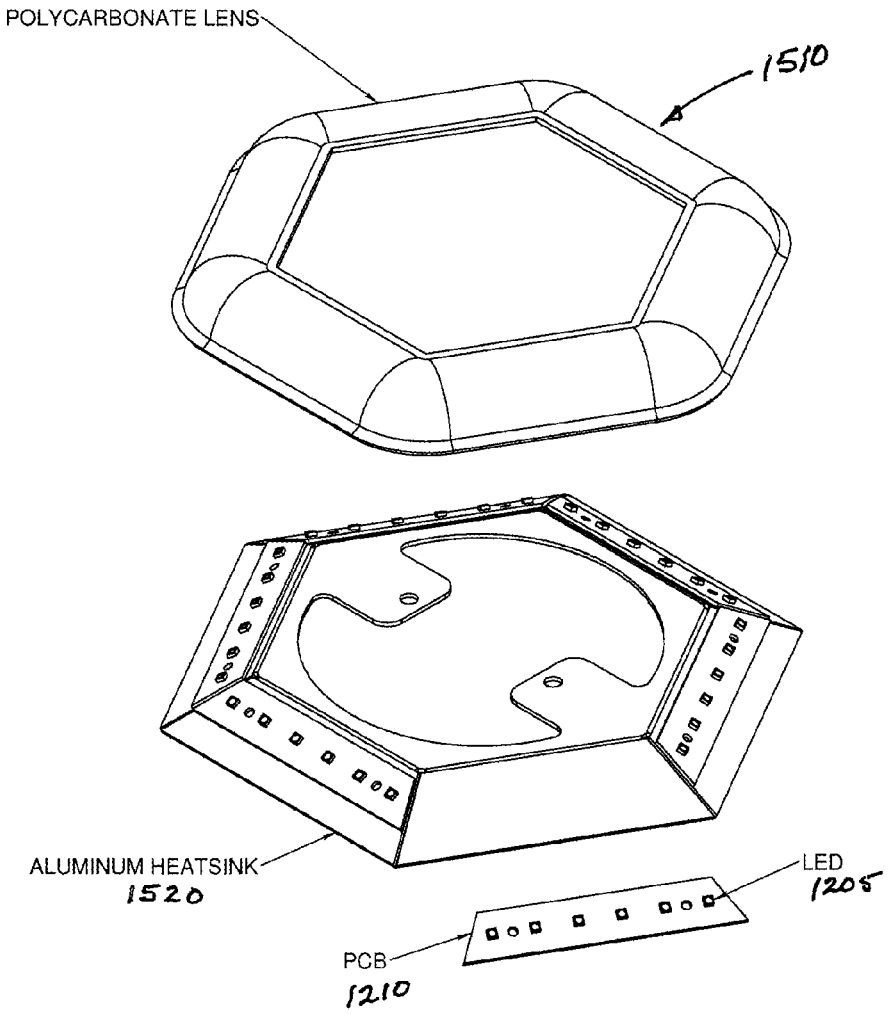
FIG. 15 shows schematically one embodiment of a circular lamp after attachment of LEDs and after bending of the heat sink portion.
Figure 16:
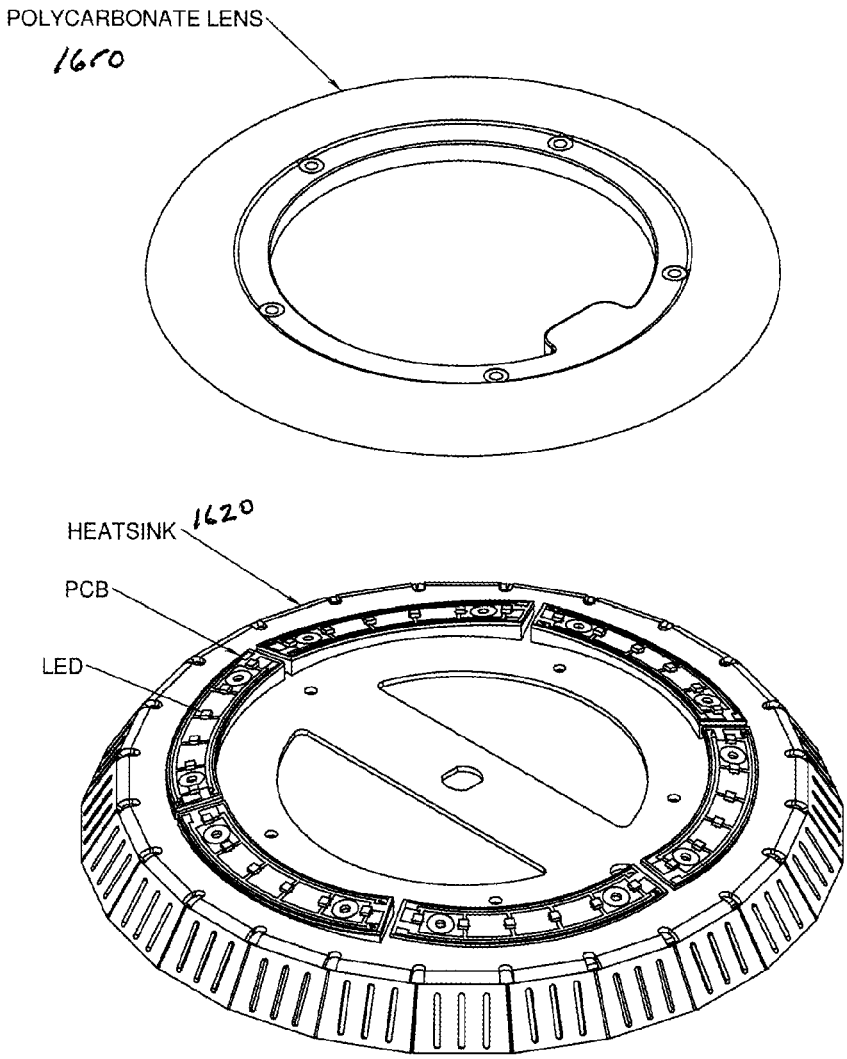
FIG. 16 shows schematically one embodiment of a circular lamp after attachment of LEDs and after bending of the heat sink portion.

FIG. 13 shows various components of a circular embodiment of a flexible heat sink lamp. Lamp 1330 comprises a polycarbonate lens 1310, pcb 1210, LED 1205, heat sink, optionally aluminum, 1320, exchangeable power supply 1350. FIG. 14 shows an expanded inset of lamp 1200 after flexible heat sink 1220 has been bent down polycarbonate lens cover 1410 placed over LED 1205. FIG. 15 shows exemplary polycarbonate lens 1510, alternative heat sink 1520, optionally aluminum, exemplary pcb 1210 and LED 1205. FIG. 16 shows exemplary lens cover 1610, exemplary heat sink 1620 bent such that it can be inserted into a matching flexible heat sink with appropriate pcb and LEDs. FIG. 17 is a copy of a data set showing lighting uniformity of an exemplary circular lamp with flexible heat sink.

Other embodiments featuring a flexible heat sink comprise various sizes, 2 to 12 inches diagonal, and shapes, circles, squares, hexagons and polygons, all tailored to match the requirement of various end products. The LED tilt angle is set to meet an illumination target. By incorporating all these features together, the invention, the circular LED lamp, achieves uniform illumination over 180 degrees or a hemisphere. Thermal management is enhanced by design; intelligence is optional.

The apparatus and method are described for the sake of grammatical fluidity with functional explanations; it is expressly understood that the claims are not to be construed as necessarily limited in any way by the construction of "means" or "steps" limitations, but are to be accorded the full scope of the meaning and equivalents of the definition provided by the claims under the judicial doctrine of equivalents. In the case where the claims are interpreted to be formulated expressly under 35 U.S.C. 112, the claims are to be accorded full statutory equivalents under 35 U.S.C. 112. Embodiments of the invention can be visualized by the drawings wherein like elements are referenced by like numerals.

All patents, patent applications, and other documents referenced herein are incorporated by reference in their entirety for all purposes, unless otherwise indicated.

Foregoing described embodiments of the invention are provided as illustrations and descriptions. They are not intended to limit the invention to precise form described. In particular, it is contemplated that functional implementation of invention described herein may be implemented equivalently. Alternative construction techniques and processes are apparent to one knowledgeable with integrated circuit, light emitting device, hybrid assembly, flexible circuit and luminaire technologies. Other variations and embodiments are possible in light of above teachings, and it is thus intended that the scope of invention not be limited by this Detailed Description, but rather by Claims following.

We claim:

1. A solid state lighting apparatus comprising;

a solid state lighting array comprising a plurality of LEDs and a substrate;

a first heat sink operable to support a substrate on which the solid state lighting array is mounted comprising a flexible portion;

an expander portion comprising electrical components and at least one tension screw;

a lens assembly comprising at least one optical component for each LED wherein the lens assembly is placed over the LEDs on the first heat sink such that each LED is focused in a predetermined manner; and an outer cover operable to function as a second heat sink; wherein the expander portion is operable to radially expand against the flexible portion when at least one tension screw is tightened into the expander portion such that the flexible portion is placed in thermal communication with the outer cover.

2. The solid state lighting apparatus of claim 1 wherein the lens assembly comprises at least one optical component chosen from a group consisting of side emitting lens, image forming aspheric lens, horizontally isotropic lens, holographic engineered diffuser lens, and aspheric collimating lens and mirror.

3. The solid state lighting apparatus of claim 1 wherein the electrical components comprise at least one chosen from a group consisting of dynamic bleeder, discontinuous mode controller, boost converter, thermal foldback unit, thermal feedback module, temperature sensor, means for communication, means for computing, means for dimming and means for modulating color of the LEDs and power supply.

4. The solid state lighting apparatus of claim 1 wherein the outer cover is chosen from a group consisting of cylinders, cones, ellipsoids and other shapes operable to make thermal contact with a flexible, expandable heat sink.

5. The solid state lighting apparatus of claim 1 wherein the plurality of LEDs are maintained at a temperature of 85° C. or less when dissipating less than about 300 watts.

* * * * *